US011313369B2

(12) United States Patent
Liu et al.

(10) Patent No.: US 11,313,369 B2
(45) Date of Patent: Apr. 26, 2022

(54) SLIDE VALVE FOR COMPRESSOR AND SCREW COMPRESSOR WITH SLIDE VALVE

(71) Applicant: Gree Electric Appliances, Inc. of Zhuhai, Guangdong (CN)

(72) Inventors: Hua Liu, Guangdong (CN); Tianyi Zhang, Guangdong (CN); Helong Zhang, Guangdong (CN); Rihua Li, Guangdong (CN); Yungong Xu, Guangdong (CN); Baoge Zhang, Guangdong (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 160 days.

(21) Appl. No.: 16/496,028

(22) PCT Filed: Mar. 19, 2018

(86) PCT No.: PCT/CN2018/079462
§ 371 (c)(1),
(2) Date: Sep. 20, 2019

(87) PCT Pub. No.: WO2018/171551
PCT Pub. Date: Sep. 27, 2018

(65) Prior Publication Data

US 2021/0115924 A1 Apr. 22, 2021

(30) Foreign Application Priority Data

Mar. 20, 2017 (CN) ..... 201710166152.2

(51) Int. Cl.
*F03C 2/00* (2006.01)
*F03C 4/00* (2006.01)
(Continued)

(52) U.S. Cl.
CPC ..... *F04C 28/12* (2013.01); *F04C 18/16* (2013.01); *F04C 29/06* (2013.01); *F04C 2270/135* (2013.01)

(58) Field of Classification Search
CPC ..... F04C 18/16; F04C 28/12; F04C 28/125; F04C 29/06; F04C 2270/135
See application file for complete search history.

(56) References Cited

U.S. PATENT DOCUMENTS 4,025,244 A * 5/1977 Sato ..... F04C 27/02 418/87
4,281,975 A * 8/1981 Blackwell ..... F04C 28/12 418/201.2

(Continued)

FOREIGN PATENT DOCUMENTS

CN 1846066 A 10/2006
CN 101979880 A 2/2011

(Continued)

OTHER PUBLICATIONS

CN 205013302U—Zhang et al.—Tonifying qi structure and helical-lobe compressor—Feb. 3, 2016—English Translation—(Year : 2016).*

(Continued)

*Primary Examiner* — Theresa Trieu
(74) *Attorney, Agent, or Firm* — McAndrews, Held & Malloy, Ltd.

(57) ABSTRACT

Some embodiments of the present disclosure provide a slide valve for a compressor and a screw compressor with the slide valve. The slide valve for the compressor includes a slide valve main body (10), the slide valve main body (10) is provided with a gas replenishing chamber (11) therein, a surface, facing to a compression chamber of the compressor, of the slide valve main body (10) is provided with a gas replenishing outlet hole (12), and the gas replenishing outlet (Continued)

hole (12) is in communication with the gas replenishing chamber (11).

6 Claims, 3 Drawing Sheets

(51) Int. Cl.

| | |
|---|---|
| ***F04C 18/00*** | (2006.01) |
| ***F04C 2/00*** | (2006.01) |
| ***F04C 28/12*** | (2006.01) |
| ***F04C 18/16*** | (2006.01) |
| *F04C 29/06* | (2006.01) |

(56) References Cited

U.S. PATENT DOCUMENTS

| | | | | |
|---|---|---|---|---|
| 8,459,963 | B2 | 6/2013 | Pileski | |
| 8,888,466 | B2 | 11/2014 | Nemit, Jr. | |
| 2008/0304990 | A1* | 12/2008 | Andersen | F04C 28/12 418/201.2 |
| 2010/0202904 | A1* | 8/2010 | Pileski | F04C 28/12 418/201.2 |
| 2017/0276137 | A1* | 9/2017 | Yang | F04C 18/16 |
| 2017/0284399 | A1* | 10/2017 | Yang | F04C 18/16 |

FOREIGN PATENT DOCUMENTS

| | | | | |
|---|---|---|---|---|
| CN | 104948464 | A | 9/2015 | |
| CN | 205013302 | U | 2/2016 | |
| CN | 205243853 | U | 5/2016 | |
| CN | 105889073 | A | 8/2016 | |
| CN | 106401965 | A | 2/2017 | |
| CN | 106949051 | A | 7/2017 | |
| CN | 206801868 | U | 12/2017 | |
| EP | 3660314 | A1 * | 6/2020 | F04C 18/16 |
| JP | H7-19188 | A | 1/1995 | |
| JP | 2005030362 | A * | 2/2005 | F04C 28/12 |
| JP | 2005030362 | A | 2/2005 | |
| JP | 2016-130483 | A | 7/2016 | |

OTHER PUBLICATIONS

CN206801868U—Zhang et al.—Guiding valve and have its helical-lobe compressor for compressor—Dec. 26, 2017—copy of the English Translation (Year: 2017).*

International Search Report, dated Jun. 12, 2018, in International application No. PCT/CN2018/079462, filed on Mar. 19, 2018.

The extended European search report for Application No. 18770488.7, dated Dec. 18, 2020, European Patent Office, Germany (7 pages).

Chinese search report in Chinese application No. 2017101661522 (2 pages).

* cited by examiner

SLIDE VALVE FOR COMPRESSOR AND SCREW COMPRESSOR WITH SLIDE VALVE

RELATED APPLICATIONS

The present disclosure is a national phase entry under 35 U.S.C. § 371 of International Patent Application No. PCT/CN2018/079462, filed Mar. 19, 2018, entitled "Slide Valve for Compressor and Screw Compressor Having Same," which claims priority to Chinese Patent Application No. 201710166152.2, filed on Mar. 20, 2017, and entitled "Slide Valve for Compressor and Screw Compressor Having Same," both of which are incorporated herein by reference in their entirety.

TECHNICAL FIELD

Some embodiments of the present disclosure relate to a field of air conditioning devices, and in particular to a slide valve for a compressor and a screw compressor with the slide valve.

BACKGROUND

A great refrigerating capacity may be required in some situations in a market, however a size of a former refrigerating unit may not be changed. In order to meet the market demand, an economizer needs to be added to the refrigerating unit, to mix high-pressure gases and lead mixed gas to a compression chamber of a compressor after achieving a required pressure. In this way, an objective of increasing the refrigerating capacity may be achieved.

For a related screw compressor, most of the screw compressors may take an axial gas replenishing mode, and an axial gas replenishing process is as follows: a gas channel is processed on a compressor body; when a gas replenishing structure switches on to replenish the gas, air may enter into a gas replenishing hole which is reserved on the compressor body through a gas replenishing port disposed on an outer surface of the compressor body; then the gas may enter into a gas replenishing hole of an exhaust bearing base of the compressor and enter into a rotor compression chamber subsequently after rotation, to complete the gas replenishing process. A diameter ϕ of the gas replenishing hole in the conventional art is 20 mm. There are problems that the air may have great pulsation in a gas replenishing channel, a great extra exciting force may be generated, and noise of the compressor may be increased.

SUMMARY

Some embodiments of the present disclosure provide a slide valve for a compressor capable of reducing noise and a screw compressor with the slide valve.

An embodiment of the present disclosure provides a slide valve for a compressor, including a slide valve main body, a gas replenishing chamber and a gas replenishing outlet hole, wherein the gas replenishing chamber is disposed in the slide valve main body, the gas replenishing outlet hole is provided on a surface, facing to a compression chamber of the compressor, of the slide valve main body, and the gas replenishing outlet hole is in communication with the gas replenishing chamber.

In an exemplary embodiment, the slide valve main body includes a top central line, two sides of the top central line is provided with at least one group of gas replenishing outlet hole group respectively, and the at least one group of gas replenishing outlet hole group includes at least one gas replenishing outlet hole.

In an exemplary embodiment, along an extension direction of the top central line, an end of the slide valve main body is provided with an opening which is in communication with the gas replenishing chamber, the slide valve for the compressor further includes a sealing and pressing plate, the sealing and pressing plate is fixedly provided on the slide valve main body, and seals the opening.

In an exemplary embodiment, the slide valve includes a gas replenishing inlet hole provided on a side of the slide valve main body, wherein the gas replenishing inlet hole is in communication with the gas replenishing chamber.

In an exemplary embodiment, the gas replenishing chamber includes a round cross section, and a diameter of the gas replenishing chamber is 45 mm-55 mm.

In an exemplary embodiment, the gas replenishing outlet hole includes a round cross section, and a diameter of the gas replenishing outlet hole is 4 mm-6 mm.

Some embodiments of the present disclosure provide a screw compressor, including a compressor body, a screw disposed in a rotor chamber of the compressor body and a slide valve disposed inside the compressor body. The slide valve is the abovementioned slide valve for the compressor, and a side, provided with a gas replenishing outlet hole, of the slide valve faces to the rotor chamber of the compressor body.

In an exemplary embodiment, there are two screws meshed with each other, and a top central line of the slide valve corresponds to a connecting line of points of intersection of inner circles of the two screws.

In an exemplary embodiment, the screw compressor further includes a gas replenishing pipe, the gas replenishing pipe passes through the compressor body, and is coupled to the slide valve and in communication with the gas replenishing chamber of the slide valve.

In accordance with the slide valve for the compressor and the screw compressor with the same in some embodiments of the present disclosure, the slide valve main body is provided with the gas replenishing chamber therein, the surface, facing to the compression chamber, of the slide valve main body is provided with the gas replenishing outlet hole, to buffer the air. In this way, when the compressor replenishes the gas, gas pulsation may be effectively reduced. Accordingly, vibration and noise of the compressor may be reduced.

BRIEF DESCRIPTION OF THE DRAWINGS

The accompanying drawings described herein are used to provide a further understanding of the present disclosure, and constitute a part of the present application, and the exemplary embodiments of the present disclosure and the description thereof are used to explain the present disclosure, but do not constitute improper limitations to the present disclosure. In the drawings.

EXPLANATION OF REFERENCE NUMBERS

10. Slide valve main body; 11. gas replenishing chamber; 12. gas replenishing outlet hole; 13. top central line; 14. sealing and pressing plate; 15. gas replenishing inlet hole; 30. compressor body; 31. screw; 32. gas replenishing pipe.

DETAILED DESCRIPTION OF THE EMBODIMENTS

The present disclosure will be described in detail below by using drawings for reference and in combination with the embodiments.

Figure 1:
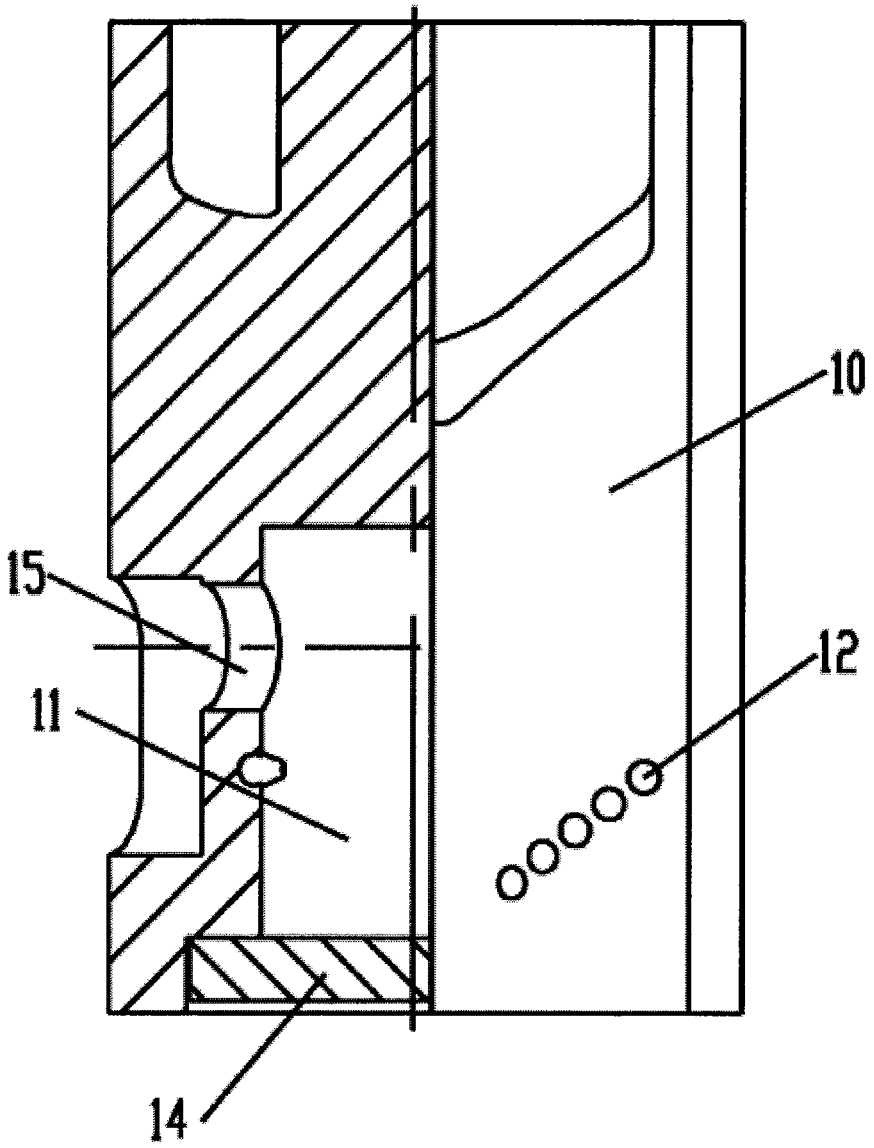
FIG. 1 is a structure diagram of a slide valve for a compressor according to an embodiment of the present disclosure.
Figure 2:
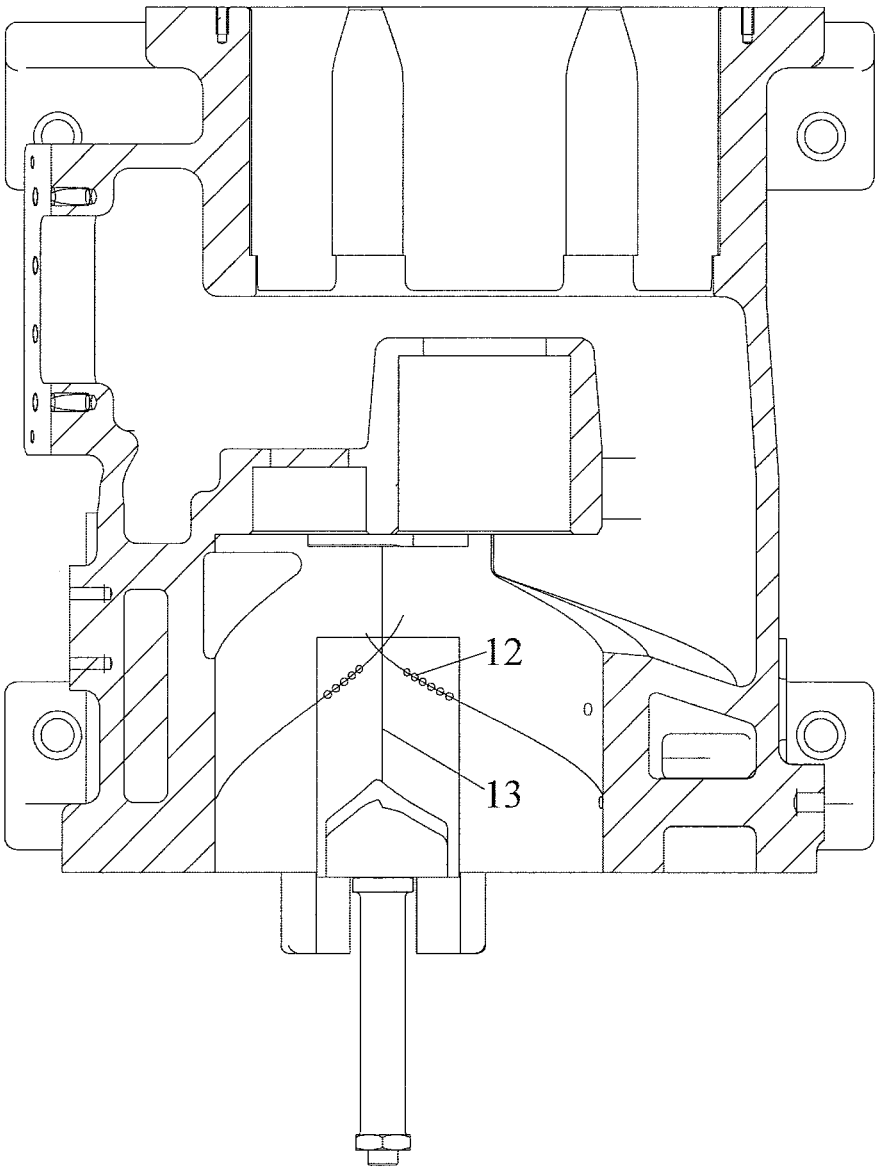
FIG. 2 is a transverse cross-section structure diagram of a screw compressor according to an embodiment of the present disclosure.
Figure 3:
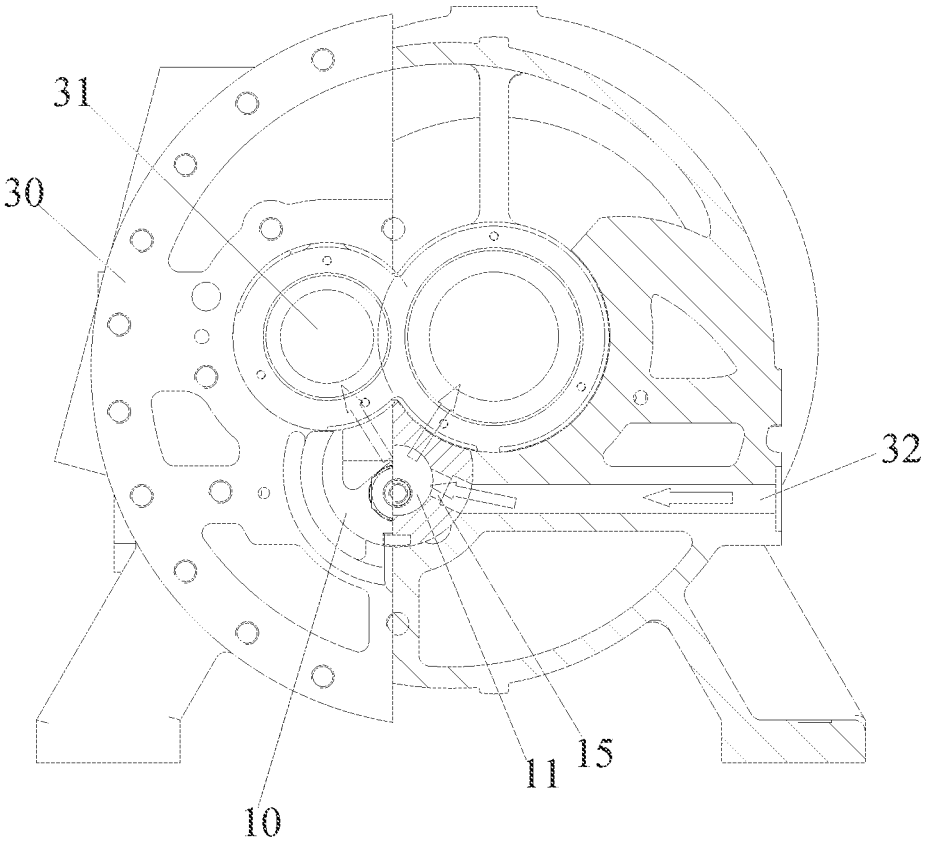
FIG. 3 is a longitudinal cross-section structure diagram of a screw compressor according to an embodiment of the present disclosure.

As shown in FIG. 1, FIG. 2 and FIG. 3, according to an embodiment of the present disclosure, a slide valve for a compressor includes a slide valve main body 10. The slide valve main body 10 is provided with a gas replenishing chamber 11 therein. A surface, facing to a compression chamber of the compressor, of the slide valve main body 10 is provided with a gas replenishing outlet hole 12, and the gas replenishing outlet hole 12 is in communication with the gas replenishing chamber 11. The slide valve main body 10 is provided with the gas replenishing chamber 11 therein, by which air is buffered to some extent, and gas pulsation is reduced. Accordingly, noise of the compressor caused due to air impact during replenishing gas is reduced, the noise when the compressor works is reduced, and comfort is improved during using.

By referring to FIG. 1, FIG. 2 and FIG. 3, the slide valve main body 10 includes a top central line 13. When the slide valve main body 10 is installed on a dual-screw compressor, points on the top central line 13 correspond to points of intersection of inner circles of two screws 31 one to one. A side, facing to the compression chamber, of the slide valve main body 10 is a curve surface including an arc surface on two sides of the top central line 13.

In an exemplary embodiment, two sides of the top central line 13 are provided with at least one group of gas replenishing outlet hole group (each arc surface is provided with at least one group of gas replenishing outlet hole group), respectively. The at least one group of gas replenishing outlet hole group includes at least one gas replenishing outlet hole 12. Two sides of the top central line 13 are provided with the at least one group of gas replenishing outlet hole group, thereby ensuring an enough gas replenishing quantity. A specific quantity of the gas replenishing outlet hole groups is determined in accordance with the need, for example, more gas replenishing outlet hole groups may be configured when the required gas replenishing quantity is great. A quantity of the gas replenishing outlet holes 12 inside each gas replenishing outlet hole group may be determined in accordance with the required gas replenishing quantity as well. For example, eleven gas replenishing outlet holes 12 is disposed on the slide valve main body 10.

A plurality of gas replenishing outlet holes 12 in one gas replenishing outlet hole group is provided along a helix line of the screw of the screw compressor, as to ensure that each of the plurality of gas replenishing outlet holes 12 corresponds to a groove between two teeth of the screw 31. Accordingly, a gas replenishing effect is ensured.

The gas replenishing outlet hole 12 may be the hole disposed on the slide valve main body 10, or the slide valve main body 10 may be fixedly connected with an air duct thereon, and a gas outlet of the air duct may be taken as the gas replenishing outlet hole 12.

As shown in FIG. 1, the gas replenishing chamber 11 has a round cross section, a range of a diameter of the gas replenishing chamber 11 is 45 mm-55 mm. In an exemplary embodiment, the diameter of the gas replenishing chamber 11 is 49 mm. In this way, the gas replenishing quantity is ensured, and an effect of buffering and reducing noise is ensured. Furthermore, a structural strength of the slide valve main body 10 is ensured. Of course, the diameter of the gas replenishing chamber 11 may be 45 mm, 48 mm, 50 mm, 52 mm, 55 mm and so on.

The gas replenishing outlet hole 12 has a round cross section, and a diameter of the gas replenishing outlet hole 12 is 4 mm-16 mm. In an exemplary embodiment, the diameter of the gas replenishing outlet hole 12 is 5 mm.

In the embodiment, along an extension direction of the top central line 13, an end of the slide valve main body 10 is provided with an opening which is in communication with the gas replenishing chamber 11. In this way, the gas replenishing chamber 11 is processed inside the slide valve main body 10 easily, a production cost is reduced. The slide valve for the compressor may further include a sealing and pressing plate 14. The sealing and pressing plate 14 is fixedly coupled to the slide valve main body 10, and seals the opening. By the configured sealing and pressing plate 14, air tightness of the gas replenishing chamber 11 is ensured, and air leakage is prevented. Accordingly, the gas replenishing effect is ensured. The sealing and pressing plate 14 may be fixedly connected to the slide valve main body 10 by fixation with a bolt, welding, riveting and other methods.

In an exemplary embodiment, the side of the slide valve main body 10 is provided with a gas replenishing inlet hole 15 which is in communication with the gas replenishing chamber 11. By the gas replenishing inlet hole 15, gas is led into the gas replenishing chamber 11 of the slide valve main body 10, so as to replenish for the compressor.

According to some embodiments of the present disclosure, a screw compressor is provided, including a compressor body 30, a screw 31 disposed in a rotor chamber of the compressor body 30 and a slide valve disposed inside the compressor body 30. The slide valve is the abovementioned slide valve for the compressor. A side, provided with a gas replenishing outlet hole 12, of the slide valve faces to the rotor chamber of the compressor body 30. The screw compressor is provided with the slide valve therein, in this way gas pulsation may be reduced when the compressor replenishes gas. Accordingly, noise caused due to replenishment of the gas may be reduced.

In an exemplary embodiment, there are two screws 31 meshed with each other. A top central line 13 of the slide valve corresponds to a connecting line of points of intersection of inner circles of the two screws 31. In this way, a gas replenishing effect of the gas replenishing outlet hole 12 on the slide valve main body 10 may be ensured.

In at least one embodiment, the screw compressor may further include a gas replenishing pipe 32. The gas replenishing pipe 32 passes through the compressor body 30, and is connected to the slide valve and in communication with the gas replenishing chamber 11 of the slide valve. By the gas replenishing pipe 32, the gas may be led into a gas replenishing chamber 11 of the slide valve main body 10.

When the slide valve is assembled with the compressor body 30, a gas replenishing inlet hole 15 of the slide valve is in communication with a gas replenishing port of the compressor body 30. There are eleven small holes, the diameter is Φ5 mm.

As shown in FIG. 3, one gas replenishing chamber 11 is disposed inside the slide valve main body 10. In an exemplary embodiment, the gas replenishing chamber 11 is a hollow chamber with a diameter ϕ of 49 mm and a length of 65 mm. An arc surface on which the slide valve main body 10 is in contact with a rotor (the screw 31) is provided with the gas replenishing outlet holes 12. There are eleven gas replenishing outlet holes 12, with diameters ϕ of 5 mm. A calculated gas replenishing area is equivalent to one gas replenishing hole with a diameter ϕ of 16.58 mm. When it is opened for replenishing the gas, the gas may enter into the gas replenishing chamber 11 by the gas replenishing port and the gas replenishing pipe 32 on the compressor body 30, and there is a buffering in the gas replenishing chamber 11. Then the gas may enter into a rotor compression chamber by the gas replenishing outlet hole 12 on the arc surface, as to complete a gas replenishing process. In addition, with the adoption of the gas replenishing outlet hole 12 having the small diameter, it is conducive to reducing gas pulsation, as to accordingly reduce noise caused during replenishing the gas. Furthermore, because the diameter ϕ of the gas replenishing outlet hole 12 is 5 mm, when a rotor (the screw 31) tooth passes the gas replenishing outlet hole 12, leakage of the gas on two sides of the tooth is improved well, with the better gas replenishing effect.

The slide valve for the compressor and the screw compressor with the slide valve according to some embodiments of the present disclosure has the following technical effects.

The gas replenishing chamber is processed inside the slide valve main body, a bottom is sealed with the sealing and pressing plate. When the compressor switches on to replenish gas, the gas may have certain buffering effect in the gas replenishing chamber and reduce the gas pulsation. Then the gas may enter into the rotor (screw) compression chamber by the gas replenishing outlet hole of the arc surface of the slide valve main body, in this way the gas replenishing process may be completed. With the adoption of the slide valve, the gas pulsation caused by replenishment of the gas may be reduced, and it is conducive to reduce the noise of the compressor during replenishing the gas; furthermore, the problem that the gas is leaked when a top of the rotor (screw) tooth of the compressor passes the gas replenishing outlet hole may be improved as well.

The above is only an exemplary embodiment of the present disclosure and not intended to limit the scope of protection of the present disclosure. For those skilled in the art, the present disclosure may have various modifications and variations. Any modifications, equivalent replacements, improvements and the like made within the spirit and principle of the present disclosure shall fall within the scope of protection of the present disclosure.

What is claimed is:

1. A slide valve for a compressor, comprising a slide valve main body, a gas replenishing chamber and a gas replenishing outlet hole, wherein the gas replenishing chamber is disposed in the slide valve main body, the gas replenishing outlet hole is provided on a surface, facing to a compression chamber of the compressor, of the slide valve main body, and the gas replenishing outlet hole is in communication with the gas replenishing chamber; wherein the slide valve main body comprises a top central line, two sides of the top central line are provided with at least one group of gas replenishing outlet hole group respectively, and the at least one group of gas replenishing outlet hole group comprises at least one gas replenishing outlet hole;

wherein the slide valve comprises a gas replenishing inlet hole provided on a side of the slide valve main body, wherein the gas replenishing inlet hole is in communication with the gas replenishing chamber;

wherein the gas replenishing chamber comprises a round cross section, and a diameter of the gas replenishing chamber is 45 mm-55 mm;

wherein the gas replenishing outlet hole comprises a round cross section, and a diameter of the gas replenishing outlet hole is 4 mm-6 mm.

2. The slide valve for the compressor as claimed in claim 1, wherein along an extension direction of the top central line, an end of the slide valve main body is provided with an opening which is in communication with the gas replenishing chamber, the slide valve for the compressor further comprises a sealing and pressing plate, and the sealing and pressing plate is fixedly provided on the slide valve main body, and seals the opening.

3. A screw compressor, comprising a compressor body, a screw disposed in a rotor chamber of the compressor body and a slide valve disposed inside the compressor body, the slide valve is the slide valve for the compressor as claimed in claim 1; and a side, provided with a gas replenishing outlet hole, of the slide valve faces to the rotor chamber of the compressor body.

4. The screw compressor as claimed in claim 3, wherein there are two screws meshed with each other, and a top central line of the slide valve corresponds to a connecting line of points of intersection of inner circles of the two screws.

5. The screw compressor as claimed in claim 3, wherein the screw compressor further comprises a gas replenishing pipe, the gas replenishing pipe passes through the compressor body, and is coupled to the slide valve and in communication with the gas replenishing chamber of the slide valve.

6. The screw compressor as claimed in claim 3, wherein along an extension direction of the top central line, an end of the slide valve main body is provided with an opening which is in communication with the gas replenishing chamber, the slide valve for the compressor further comprises a sealing and pressing plate, and the sealing and pressing plate is fixedly provided on the slide valve main body, and seals the opening.

* * * * *